US010115521B2

(12) United States Patent
Hamada

(10) Patent No.: US 10,115,521 B2
(45) Date of Patent: Oct. 30, 2018

(54) MANUFACTURING METHOD FOR ELECTRONIC COMPONENT

(71) Applicant: MURATA MANUFACTURING CO., LTD., Kyoto-fu (JP)

(72) Inventor: Akinori Hamada, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 256 days.

(21) Appl. No.: 14/870,662

(22) Filed: Sep. 30, 2015

(65) Prior Publication Data

US 2016/0093434 A1 Mar. 31, 2016

(30) Foreign Application Priority Data

Sep. 30, 2014 (JP) ..... 2014-199656

(51) Int. Cl.

*H01F 27/28* (2006.01)
*H01F 17/00* (2006.01)
*H01F 41/04* (2006.01)

(52) U.S. Cl.

CPC ..... *H01F 41/046* (2013.01); *H01F 17/0013* (2013.01); *H01F 27/2804* (2013.01); *H01F 2017/0066* (2013.01); *H01F 2017/0073* (2013.01); *H01F 2027/2809* (2013.01)

(58) Field of Classification Search

CPC ..... H01F 2017/0073; H01F 17/0013; H01F 27/2804; H01F 2027/2809; H01F 41/046; H01F 2017/0066; H05K 3/0038

See application file for complete search history.

(56) References Cited

U.S. PATENT DOCUMENTS 5,593,606 A * 1/1997 Owen ..... C23C 14/046 219/121.71
5,595,943 A * 1/1997 Itabashi ..... C23C 18/36 257/E21.174

(Continued)

FOREIGN PATENT DOCUMENTS

JP 07122430 A * 5/1995
JP H07-122430 A 5/1995

(Continued)

OTHER PUBLICATIONS

Machine Translation of JP H07-122430A, obtained Apr. 27, 2018.*

(Continued)

*Primary Examiner* — Livius Radu Cazan
(74) *Attorney, Agent, or Firm* — Studebaker & Brackett PC

(57) ABSTRACT

An electronic component includes a multilayer body formed by laminating an insulator substrate and a plurality of insulator layers, a coil including coil conductors provided on the insulator substrate, and an internal magnetic path penetrating the insulator substrate. A manufacturing method for the electronic component includes: forming the coil conductors and a sacrificial conductor at the same time on a mother insulator substrate, which is the assemblage of a plurality of the insulator substrates; laminating insulator sheets, which are to be the corresponding insulator layers mentioned above, on the mother insulator substrate so as to cover the coil conductors; and exposing the sacrifice conductor by removing part of the insulator sheets.

7 Claims, 7 Drawing Sheets

(56) References Cited

U.S. PATENT DOCUMENTS

| | | | | |
|---|---|---|---|---|
| 2007/0030107 | A1* | 2/2007 | Waffenschmidt | H01F 27/2804 336/200 |
| 2010/0182116 | A1 | 7/2010 | Ishimoto et al. | |
| 2014/0009254 | A1* | 1/2014 | Ohkubo | H01F 27/2804 336/192 |

FOREIGN PATENT DOCUMENTS

| | | | | |
|---|---|---|---|---|
| JP | 2007-305824 | A | | 11/2007 |
| JP | 2007305824 | A | * | 11/2007 |
| JP | 2010-205905 | A | | 9/2010 |
| JP | 2012-134212 | A | | 7/2012 |
| JP | 2013-225718 | A | | 10/2013 |
| JP | 2014-013815 | A | | 1/2014 |

OTHER PUBLICATIONS

An Office Action; "Notice of Reasons for Rejection," issued by the Japanese Patent Office dated Apr. 4, 2017, which corresponds to Japanese Patent Application No. 2014-199656 and is related to U.S. Appl. No. 14/870,662; with English language translation.

* cited by examiner

MANUFACTURING METHOD FOR ELECTRONIC COMPONENT

CROSS-REFERENCE TO RELATED APPLICATION

This application claims benefit of priority to Japanese Patent Application No. 2014-199656 filed Sep. 30, 2014, the entire content of which is incorporated herein by reference.

TECHNICAL FIELD

The present disclosure relates to manufacturing methods for electronic components, particularly manufacturing methods for electronic components including a coil therein and provided with an internal magnetic path.

BACKGROUND

As an electronic component including a coil therein and provided with an internal magnetic path, a coil component disclosed in Japanese Unexamined Patent Application Publication No. 2013-225718 is known. In a manufacturing method for this type of an electronic component (hereinafter, referred to as "conventional electronic component manufacturing method"), for example, an insulator substrate 511 is prepared first, as shown in FIG. 20. Subsequently, as shown in FIG. 21, holes H500 used for forming internal magnetic paths are formed in the insulator substrate 511. Thereafter, as shown in FIG. 22, coil conductors 512 and 513 are provided on upper and lower surfaces of the insulator substrate 511, respectively, by photolithography or the like. In this case, in consideration of the total of positional tolerance of the hole H500 with respect to the insulator substrate 511 and positional tolerance of the coil conductors 512, 513 with respect to the insulator substrate 511, the coil conductors 512, 513 need to be distanced from the hole H500 to some extent. This makes a cross-section area of the hole H500 smaller by the amounts of the positional tolerance of the hole H500 and the positional tolerance of the conductor coils 512, 513. As a result, a cross-section area of the internal magnetic path in the electronic component manufactured by the conventional electronic component manufacturing method is caused to be smaller, thereby making it difficult to obtain high inductance.

SUMMARY

It is an object of the present disclosure to provide manufacturing methods for electronic components including a coil therein and provided with an internal magnetic path, and a manufacturing method for an electronic component capable of obtaining an electronic component having high inductance in comparison with the conventional electronic component manufacturing method.

A manufacturing method for an electronic component (hereinafter, also called "electronic component manufacturing method") according to a first aspect of the present disclosure is a manufacturing method for an electronic component including a multilayer body formed by laminating an insulator substrate and an insulator layer, a coil including a coil conductor provided on the insulator substrate, and an internal magnetic path penetrating the insulator substrate. The stated method includes: forming the coil conductor and a sacrificial conductor provided at a portion where an internal magnetic path of the insulator substrate is to be formed, at the same time on the insulator substrate; laminating the insulator layer on the insulator substrate so as to cover the coil conductor and the sacrifice conductor; and exposing the sacrifice conductor by removing part of the insulator layer laminated on the insulator substrate.

In the electronic component manufacturing method according to the aspect of the disclosure, the coil conductor and the sacrifice conductor provided at a portion where an internal magnetic path of the insulator substrate is to be formed are provided at the same time. In this case, because the coil conductor and the sacrifice conductor are both conductors, they can be formed in the same process. Then, by exposing the sacrifice conductor after the lamination of the insulator layer, it becomes possible to recognize the portion at which a through-hole is to be provided for forming the internal magnetic path. As such, in the electronic component manufacturing method according to the aspect of the present disclosure, the formation of a hole for an internal magnetic path and the formation of a coil conductor, which have been carried out based on two processes in the conventional electronic component manufacturing method, can be carried out based on a single process. Accordingly, with the electronic component manufacturing method according to the aspect of the present disclosure, the total of positional tolerance of the hole prepared for the internal magnetic path with respect to the insulator substrate and positional tolerance of the coil conductor with respect to the insulator substrate is small in comparison with the conventional electronic component manufacturing method. As a result, the electronic component manufactured by the electronic component manufacturing method according to the aspect of the present disclosure can have a larger cross-section area and obtain a higher inductance value than the electronic component manufactured by the conventional electronic component manufacturing method.

According to the present disclosure, it is possible to obtain electronic components having high inductance in comparison with the conventional electronic component manufacturing method.

Other features, elements, characteristics and advantages of the present disclosure will become more apparent from the following detailed description of preferred embodiments of the present disclosure with reference to the attached drawings.

DETAILED DESCRIPTION

Figure 1:
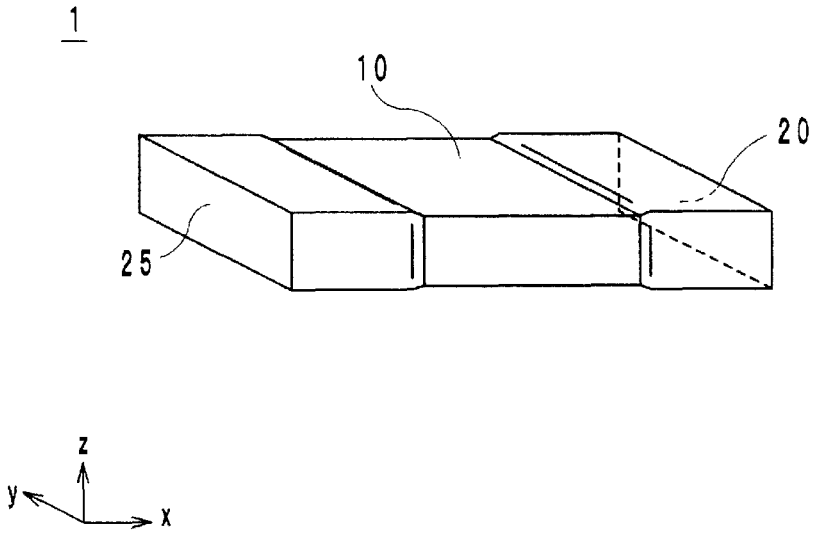
FIG. 1 is an external view of an electronic component manufactured by an electronic component manufacturing method according to a first embodiment.
Figure 2:
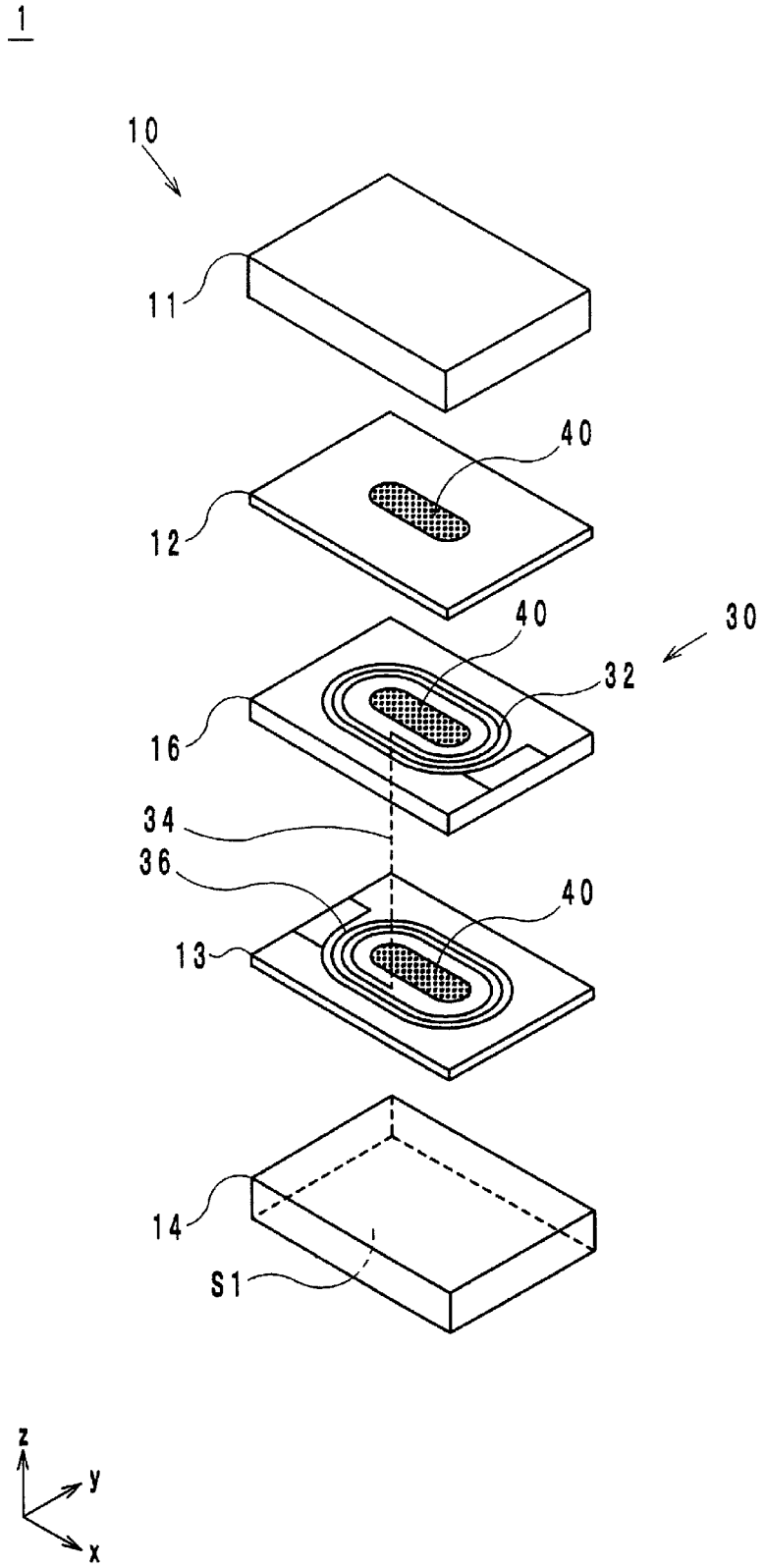
FIG. 2 is an exploded perspective view of an electronic component manufactured by the electronic component manufacturing method according to the first embodiment.

Configuration of Electronic Component (See FIGS. 1 and 2)

An electronic component 1 manufactured by an electronic component manufacturing method according to a first embodiment will be described with reference to the drawings. Hereinafter, a direction perpendicular to the bottom surface of the electronic component 1 is defined as a z-axis direction. Further, in a plan view in the z-axis direction, a direction along a longer side of the electronic component 1 is defined as an x-axis direction, and a direction along a shorter side of the electronic component 1 is defined as a y-axis direction. In addition, a surface on the negative direction side in the z-axis direction is referred to as a lower surface and a surface on the positive direction side in the z-axis direction is referred to as an upper surface. Note that the x-axis, the y-axis, and the z-axis are orthogonal to one another.

The electronic component 1 includes a multilayer body 10, outer electrodes 20 and 25, a coil 30, and an internal magnetic path 40. Further, as shown in FIG. 1, the electronic component 1 is formed in a substantially rectangular parallelepiped shape.

The multilayer body 10 is, as shown in FIG. 2, configured of insulator layers 11 through 14 and an insulator substrate 16. Further, in the multilayer body 10, the insulator layers 11 and 12, the insulator substrate 16, and the insulator layers 13 and 14 are laminated in the order from the positive direction side toward the negative direction side in the z-axis direction.

The insulator layers 11 and 14 are formed of a resin containing magnetic power, or the like. As the magnetic powder, a ferrite, a metallic magnetic material (Fe, Si, Cr, or the like), or the like can be cited; as the resin, a polyimide resin, an epoxy resin, or the like can be cited. In this embodiment, in consideration of an L value and direct-current superposition characteristics of the electronic component 1, the insulator layers 11 and 14 each contain equal to or greater than approximately 90 wt % of the magnetic powder. The insulator layer 11 is located at an end portion of the multilayer body 10 on the positive direction side in the z-axis direction. The insulator layer 14 is located at an end portion of the electronic component 1 on the negative direction side in the z-axis direction, and a bottom surface S1, which is a surface of the insulator layer 14 on the negative direction side in the z-axis direction, serves as a mounting surface when the electronic component 1 is mounted on a circuit board.

The insulator layers 12 and 13 are formed of an epoxy resin or the like. Further, the insulator layer 12 is positioned on the negative direction side with respect to the insulator layer 11 in the z-axis direction, while the insulator layer 13 is positioned on the positive direction side with respect to the insulator layer 14 in the z-axis direction. Note that a material of the insulator layers 12, 13 may be an insulative resin such as benzocyclobutene, an insulative inorganic material such as glass ceramics, or the like. Furthermore, in order to suppress generation of stray capacitance in the electronic component 1, it is preferable for a relative dielectric constant of the material of the insulator layers 12, 13 to be equal to or less than approximately 4.

The insulator substrate 16 is a printed wiring board in which an epoxy resin is impregnated into glass cloth, and is sandwiched between the insulator layer 12 and the insulator layer 13 in the z-axis direction. A material of the insulator substrate 16 may be an insulative resin such as benzocyclobutene, an insulative inorganic material such as glass ceramics, or the like. In order to reduce thickness of the electronic component 1 and improve efficiency in obtaining an inductance value thereof, it is preferable for the insulator substrate 16 to be thin as much as possible. To be more specific, the thickness of about 60 μm or less is preferable.

As shown in FIG. 1, the outer electrode 20 is so provided as to cover a surface of the multilayer body 10 on the positive direction side in the x-axis direction and part of its peripheral surfaces. Meanwhile, the outer electrode 25 is so provided as to cover a surface of the multilayer body 10 on the negative direction side in the x-axis direction and part of its peripheral surfaces. As a material that can be used for the outer electrodes 20 and 25, Au, Ag, Pd, Ni, Cu, or the like can be cited.

The coil 30 is located inside the multilayer body 10 and formed of a conductive material such as Au, Ag, Cu, Pd, Ni, or the like. Further, as shown in FIG. 2, the coil 30 is constituted of coil conductors 32, 36, and a via conductor 34.

The coil conductor 32 is provided on the upper surface of the insulator substrate 16. Further, the coil conductor 32 is a spiral conductive wire being gradually distanced from the center as it whirls counterclockwise when viewed from the positive direction side in the z-axis direction. One end of the coil conductor 32 is exposed from an outer edge of the insulator substrate 16 on the positive direction side in the x-axis direction to a surface of the multilayer body 10 and connected to the outer electrode 20. Further, the other end of the coil conductor 32 is connected to the via conductor 34 penetrating through the insulator substrate 16 in the z-axis direction.

The coil conductor 36 is provided on the lower surface of the insulator substrate 16, or on the upper surface of the insulator layer 13. Further, the coil conductor 36 is a spiral conductive wire being gradually distanced from the center as it whirls round clockwise when viewed from the positive direction side in the z-axis direction. One end of the coil conductor 36 is exposed from an outer edge of the insulator substrate 16 on the negative direction side in the x-axis direction to a surface of the multilayer body 10 and connected to the outer electrode 25. Further, the other end of the coil conductor 36 is connected to the via conductor 34.

As shown in FIG. 2, the internal magnetic path 40 is formed of a resin containing magnetic powder that is positioned approximately in the center of the interior of the multilayer body 10, and also positioned on the inner circumference side of the coil 30 when viewed from above in the z-axis direction. Further, the internal magnetic path 40 is formed in a column-like shape whose cross-section is substantially oval, penetrating the insulator layers 12, 13 and the insulator substrate 16 in the z-axis direction. As the magnetic powder used in the internal magnetic path 40, a ferrite, a metallic magnetic material (Fe, Si, Cr, or the like), or the like can be cited; as the resin, a polyimide resin, an epoxy resin, or the like can be cited. Here, in this embodiment, in consideration of an L value and direct-current superposition characteristics of the electronic component 1, the internal magnetic path 40 contains no less than 90 wt % of the magnetic powder. In addition, two kinds of powder having different particle sizes are mixed so as to raise filling ability to fill the internal magnetic path 40.

The electronic component 1 configured as described above functions as an inductor in the manner in which a signal inputted from the outer electrode 20 or 25 is outputted from the outer electrode 25 or 20 through the coil 30.

First Embodiment (See FIG. 3 Through FIG. 18)

Hereinafter, an electronic component manufacturing method according to a first embodiment will be described. Note that "z-axis direction" used in the description of the manufacturing method corresponds to the z-axis direction of the electronic component 1 manufactured by the stated manufacturing method.

Figure 3:
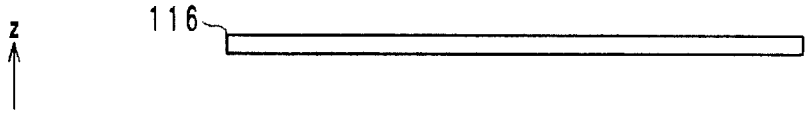
FIG. 3 is a diagram illustrating a process in the electronic component manufacturing method according to the first embodiment.
Figure 4:
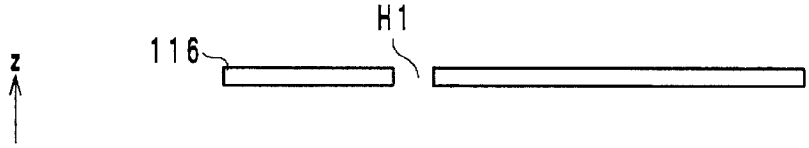
FIG. 4 is a diagram illustrating a process in the electronic component manufacturing method according to the first embodiment.

First, as shown in FIG. 3, a mother insulator substrate 116, which is to be a plurality of the insulator substrates 16, is prepared. Then, as shown in FIG. 4, a through-hole H1 for providing the via conductor 34 is formed in the mother insulator substrate 116 by laser beam processing or the like. Further, in order to remove smears generated during the formation of the through-hole H1, desmear processing is carried out.

Figure 5:
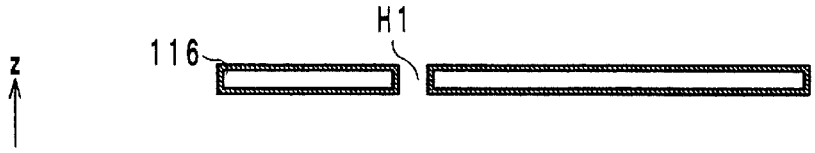
FIG. 5 is a diagram illustrating a process in the electronic component manufacturing method according to the first embodiment.

Next, as shown in FIG. 5, electroless Cu plating is applied onto the upper and lower surfaces of the mother insulator substrate 116 in which the through-hole H1 has been formed. The purpose of this electroless Cu plating is to form a seed layer for application of Cu electrolytic plating to be carried out later.

Figure 6:
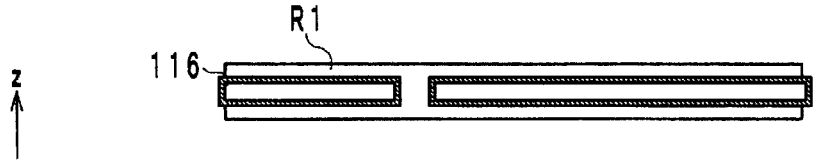
FIG. 6 is a diagram illustrating a process in the electronic component manufacturing method according to the first embodiment.

Then, as shown in FIG. 6, a photosensitive resist R1 is applied onto the upper and lower surfaces of the mother insulator substrate 116. Note that the application of the photosensitive resist R1 may be carried out by pasting a dry film resist to the upper and lower surfaces of the mother insulator substrate 116 or applying a liquid resist onto the upper and lower surfaces of the mother insulator substrate 116.

Figure 7:
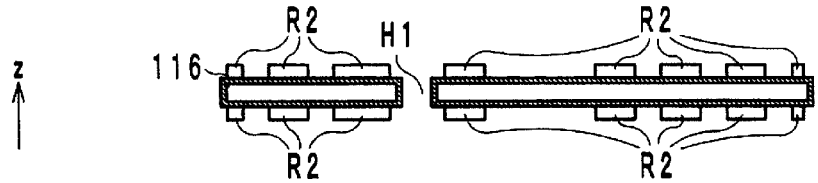
FIG. 7 is a diagram illustrating a process in the electronic component manufacturing method according to the first embodiment.

Upon completion of the application of the photosensitive resist R1, an exposure process is carried out on the mother insulator substrate 116, and a development process is further carried out. With this, resist patterns R2 are formed on the upper and lower surfaces of the mother insulator substrate 116, as shown in FIG. 7, to form the coil conductors 32, 36 and the internal magnetic path 40.

Figure 8:
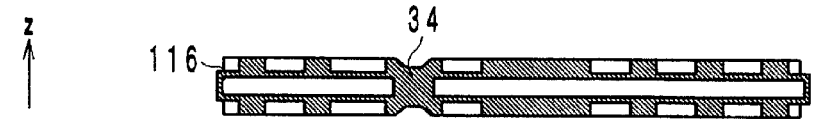
FIG. 8 is a diagram illustrating a process in the electronic component manufacturing method according to the first embodiment.

Then, as shown in FIG. 8, the Cu electrolytic plating is applied to a cavity of each resist pattern R2. At this time, the through-hole H1 is covered up with Cu so that the via conductor 34 is formed.

Figure 9:
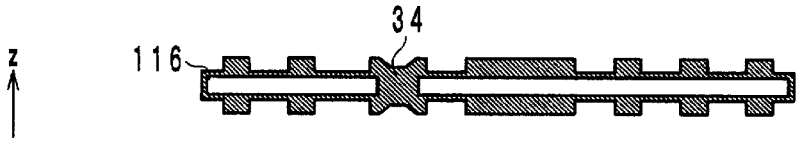
FIG. 9 is a diagram illustrating a process in the electronic component manufacturing method according to the first embodiment.
Figure 10:
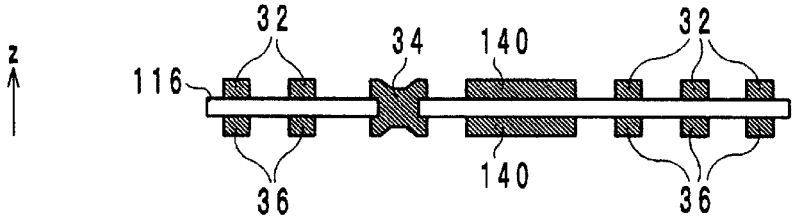
FIG. 10 is a diagram illustrating a process in the electronic component manufacturing method according to the first embodiment.

Next, as shown in FIG. 9, the resist patterns R2 are removed by an organic solvent, an alkali solvent, or the like. Further, the seed layer provided for the application of the Cu electrolytic plating is removed by a sulfuric acid-based etchant, a phosphoric acid-based etchant, or the like, whereby a plurality of the coil conductors 32 and a plurality of the coil conductors 36 are formed as shown in FIG. 10. At this time, also at a portion corresponding to the internal magnetic path 40 on the mother insulator substrate 116, conductor layers (hereinafter, referred to as sacrifice conductors 140) are formed.

Figure 11:
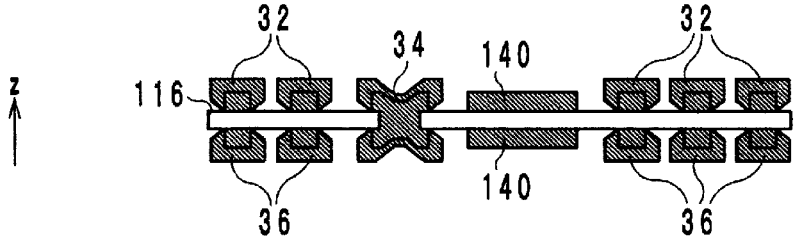
FIG. 11 is a diagram illustrating a process in the electronic component manufacturing method according to the first embodiment.

After the formation of the plurality of coil conductors 32, the plurality of coil conductors 36, and the sacrifice conductors 140, additional Cu plating is further applied. The purpose of this is, by making the plurality of coil conductors 32 and the plurality of coil conductors 36 thicker, to shorten the distances between the conductors, as shown in FIG. 11.

Figure 12:
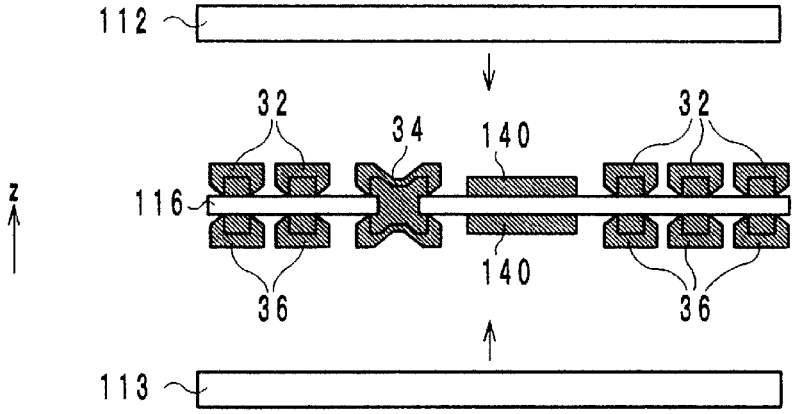
FIG. 12 is a diagram illustrating a process in the electronic component manufacturing method according to the first embodiment.
Figure 13:
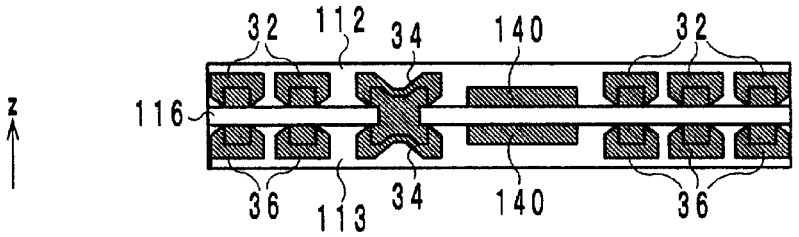
FIG. 13 is a diagram illustrating a process in the electronic component manufacturing method according to the first embodiment.

Then, as shown in FIG. 12, the mother insulator substrate 116 where the plurality of coil conductors 32, the plurality of coil conductors 36, and the sacrifice conductors 140 are formed is sandwiched, in the z-axis direction, between insulator sheets 112 and 113 that are to be a plurality of the insulator layers 12 and a plurality of the insulator layers 13. At this time, by using a vacuum multi-stage press machine or the like, the insulator sheets 112 and 113 also enter into small gaps between the coil conductors, as shown in FIG. 13.

Figure 14:
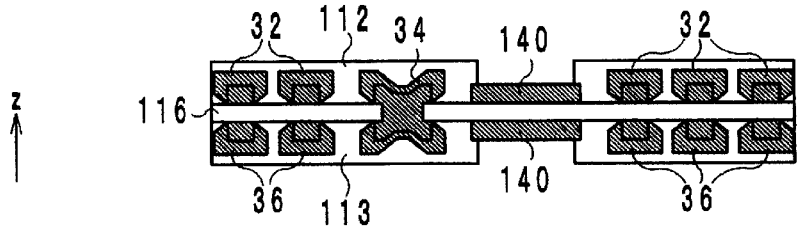
FIG. 14 is a diagram illustrating a process in the electronic component manufacturing method according to the first embodiment.
Figure 15:
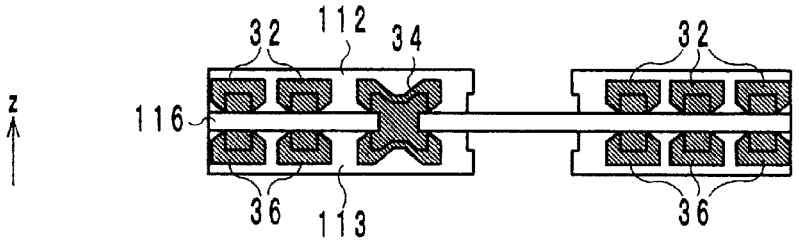
FIG. 15 is a diagram illustrating a process in the electronic component manufacturing method according to the first embodiment.

Thereafter, as shown in FIG. 14, portions of the insulator sheets 112 and 113 covering the sacrifice conductors 140 are removed by laser beam processing, dry etching, or the like so as to expose the sacrifice conductors 140. Subsequently, the mother insulator substrate 116 with the sacrifice conductors 140 being exposed is impregnated with an etching solution. This removes the sacrifice conductors 140 and exposes a portion of the mother insulator substrate 116 where the internal magnetic path 40 is to be formed, as shown in FIG. 15. Note that it is possible to quickly remove the sacrifice conductors 140 made of Cu by using ferric chloride in an etching solution. Further, due to presence of the sacrifice conductors 140, the portions of the insulator sheets 112 and 113 covering the sacrifice conductors 140 are expanded in comparison with other portions, or have a different color from that of the other portions. Accordingly, taking the above expanding portions or the like as a target mark, the portions of the insulator sheets 112 and 113 covering the sacrifice conductors 140 can be removed by laser beam processing, dry etching, or the like.

Figure 16:
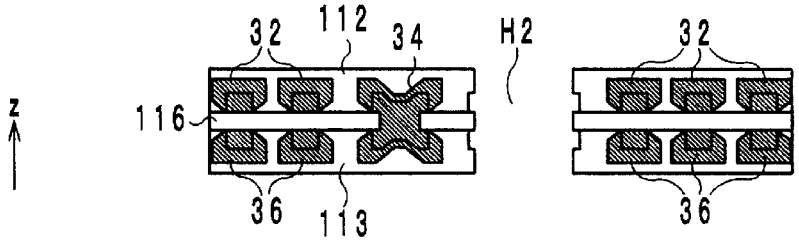
FIG. 16 is a diagram illustrating a process in the electronic component manufacturing method according to the first embodiment.

Subsequently, laser beam processing, drilling, or the like is performed on the exposed portion where the internal magnetic path 40 is to be formed. With this, a through-hole H2 penetrating the mother insulator substrate 116 is formed as shown in FIG. 16. Note that this process and the above-described removal process in which the portions of the insulator sheets 112 and 113 covering the sacrifice conductors 140 are removed may be carried out at the same time.

Figure 17:
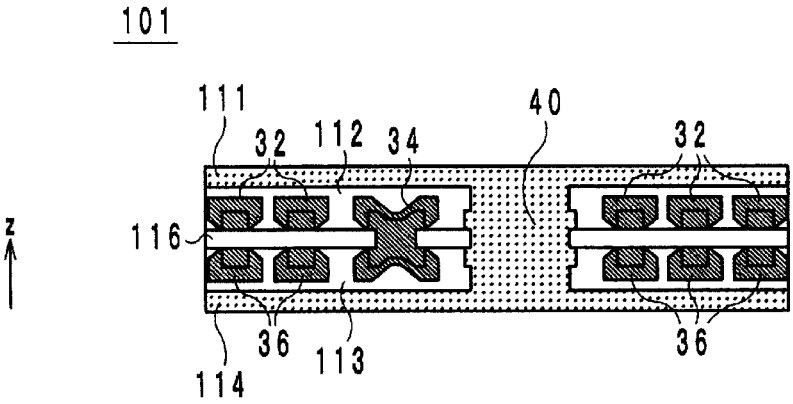
FIG. 17 is a diagram illustrating a process in the electronic component manufacturing method according to the first embodiment.

After the formation of the through-hole H2, the multilayer body in which the insulator sheet 112, the mother insulator substrate 116, and the insulator sheet 113 are laminated in that order is sandwiched and press-bonded in the z-axis direction between resin sheets 111 and 114 containing metallic magnetic powder and corresponding to the insulator layers 11 and 14, respectively. With this press-bonding, as shown in FIG. 17, the resin sheets 111 and 114 containing metallic magnetic powder enter into a plurality of through-holes H2 so as to provide the internal magnetic paths 40. Thereafter, heat treatment is performed using a constant-temperature bath such as an oven or the like so as to cure the resin sheets. Through this, a mother substrate 101 which is the assemblage of a plurality of the electronic components 1 is completed.

Next, the mother substrate 101 is divided into a plurality of electronic components. More specifically, the mother substrate 101 is cut with a dicer or the like so that the mother substrate 101 is divided into the plurality of electronic components.

Finally, the outer electrodes 20 and 25 are formed. First, an electrode paste formed of a conductive material whose main component is Ag is applied to surfaces of an electronic component having been divided from the mother substrate 101. Next, the applied paste undergoes heat treatment for about 5 to 12 minutes at a temperature of approximately 80 to 200° C., for example. With this, base electrodes of the outer electrodes 20 and 25 are formed. Then, surfaces of the base electrodes are plated with Ni/Sn, thereby forming the outer electrodes 20 and 25. Through the processes having been discussed thus far, the electronic component 1 is completed.

Effects

In the electronic component manufacturing method according to the first embodiment, the coil conductors 32, 36 and the sacrifice conductors 140 to be provided at a portion where the internal magnetic path 40 of the insulator substrate 16 is to be formed, are provided at the same time. In this case, since the coil conductors 32, 36 and the sacrifice conductors 140 are both made of Cu, they can be formed in a single process. Further, by exposing the sacrifice conductors 140 after the insulator layers 12 and 13 having been laminated, it is possible to recognize a portion where the through-hole H2 is to be provided for forming the internal magnetic path 40. As such, in the electronic component manufacturing method according to the first embodiment, formation of a hole for an internal magnetic path and formation of a conductor coil, which have been carried out based on two processes in the conventional electronic component manufacturing method, can be carried out based on a single process. Because of this, in the electronic component manufacturing method according to the first embodiment, the total of positional tolerance of the hole H2 prepared for forming the internal magnetic path with respect to the insulator substrate 16 and positional tolerance of the coil conductors 32, 36 with respect to the insulator substrate 16 is smaller than that in the conventional electronic component manufacturing method. Therefore, a large distance is not needed between the hole H2 and the coil conductors 32, 36. As a result, the electronic component 1 manufactured by the electronic component manufacturing method according to the first embodiment can have a large cross-section of the internal magnetic path and a large inductance value in comparison with the electronic component manufactured by the conventional electronic component manufacturing method.

Figure 18:
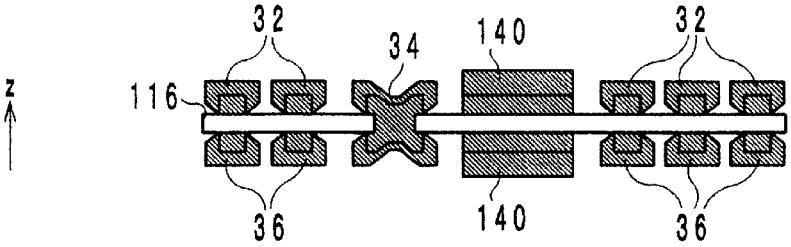
FIG. 18 is a diagram illustrating a process in an electronic component manufacturing method according to a second embodiment.
Figure 19:
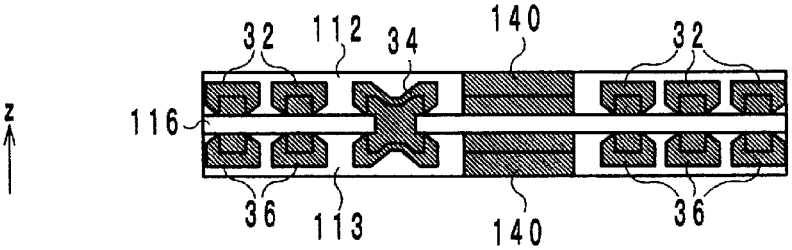
FIG. 19 is a diagram illustrating a process in the electronic component manufacturing method according to the second embodiment.
Figure 20:
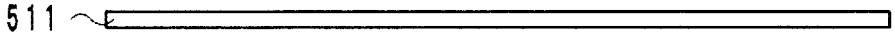
FIG. 20 PRIOR ART
FIG. 20 is a diagram illustrating a process in a conventional electronic component manufacturing method.
Figure 21:
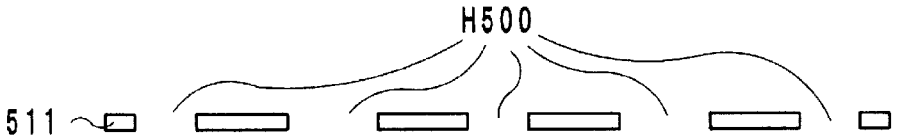
FIG. 21 PRIOR ART
FIG. 21 is a diagram illustrating a process in the conventional electronic component manufacturing method.
Figure 22:
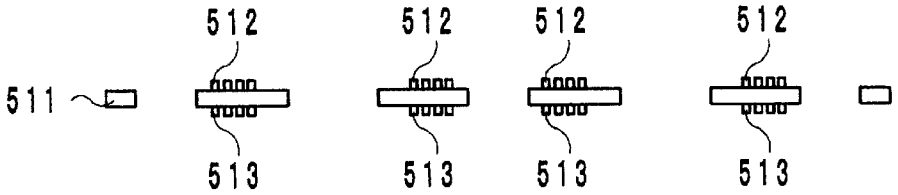
FIG. 22 PRIOR ART
FIG. 22 is a diagram illustrating a process in the conventional electronic component manufacturing method.

Second Embodiment (See FIGS. 18 and 19)

An electronic component manufacturing method according to a second embodiment differs from the electronic component manufacturing method according to the first embodiment mainly in a process of applying Cu plating and a process of exposing the sacrifice conductor 140. Details thereof will be described below.

In the electronic component manufacturing method according to the second embodiment, when the plurality of coil conductors 32, the plurality of coil conductors 36, and the sacrifice conductors 140 are plated with Cu, the height of the sacrifice conductors 140 is made higher than that of the coil conductors 32 and 36, as shown in FIG. 18, by adjusting the plating current density and agitation conditions of the plating solution. Thereafter, additional Cu plating is further applied to the plurality of coil conductors 32 and the plurality of coil conductors 36 so as to shorten the distances between the respective conductors.

Further, in the electronic component manufacturing method according to the second embodiment, when the sacrifice conductors 140 are exposed to surfaces of the insulator sheets 112 and 113, polishing processing such as grinding, buffing, lapping, or the like is carried out on the surfaces of the insulator sheets 112 and 113. At this time, since the height of the sacrifice conductors 140 is higher than that of the coil conductors 32 and 36, only the sacrifice conductors 140 are exposed, as shown in FIG. 19. Thereafter, like the electronic component manufacturing method according to the first embodiment, the sacrifice conductors 140 are removed by etching, the through holes H2 are formed, and the internal magnetic paths are provided.

The electronic component manufacturing method according to the second embodiment is simple in configuration because the sacrificial conductors 140 can be exposed by polishing processing in comparison with the electronic component manufacturing method according to the first embodiment. The other processes in the electronic component manufacturing method according to the second embodiment are the same as those in the electronic component manufacturing method according to the first embodiment. As such, in the electronic component manufacturing method according to the second embodiment, descriptions other than the descriptions of the process of applying Cu plating and the process of exposing the sacrificial conductors 140 are the same as those in the electronic component manufacturing method according to the first embodiment. Further, the electronic component manufactured by the electronic component manufacturing method according to the second embodiment is the same as the electronic component 1 manufacture by the electronic component manufacturing method according to the first embodiment.

Variation

An electronic component manufacturing method according to a variation differs from the electronic component manufacturing method according to the second embodiment in a process of forming the through-hole H2. To be more specific, in the electronic component manufacturing method according to the variation, the sacrificial conductors 140 are not removed by etching; instead, taking the sacrificial conductors 140 exposed on the surfaces of the insulator sheets

112 and 113 as target marks, laser beam processing, drilling, or the like is carried out directly on those sacrificial conductors 140. Through this, the through-hole H2 is formed in the mother insulator substrate 116 along with the removal of the sacrificial conductors 140.

The electronic component manufacturing method according to the variation is simple in configuration because a process of etching the sacrificial conductors 140 is not needed in comparison with the electronic component manufacturing method according to the first embodiment. The other processes in the electronic component manufacturing method according to the variation are the same as those in the electronic component manufacturing method according to the second embodiment. As such, in the electronic component manufacturing method according to the variation, descriptions other than the description of the process of forming the through-hole H2 are the same as those in the electronic component manufacturing method according to the second embodiment. In addition, the electronic component manufactured by the electronic component manufacturing method according to the variation is the same as the electronic component manufactured by the electronic component manufacturing method according to the second embodiment.

Other Embodiments

The electronic component manufacturing method according to the present disclosure is not limited to the above-described embodiments, and various modifications can be made thereupon without departing from the spirit and scope of the disclosure. For example, materials used as the conductors or the insulators, conditions of the heat treatment, and the like can be arbitrarily determined. Further, the embodiments and the variation may be combined.

As discussed thus far, the present disclosure is excellent in that an electronic component having a high inductance value can be obtained in the manufacturing method for the electronic component including a coil therein and provided with an internal magnetic path in comparison with the conventional electric component manufacturing method.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A manufacturing method for an electronic component including a multilayer body formed by laminating an insulator substrate and an insulator layer, a coil including a coil conductor provided on the insulator substrate, and an internal magnetic path penetrating the insulator substrate, the method comprising:

forming the coil conductor and a sacrificial conductor provided at a portion where an internal magnetic path of the insulator substrate is to be formed, at the same time on the insulator substrate;

laminating the insulator layer on the insulator substrate so as to cover the coil conductor and the sacrificial conductor; and exposing the sacrificial conductor by removing part of the insulator layer laminated on the insulator substrate using a polishing process.

2. The manufacturing method for the electronic component according to claim 1, further comprising:

removing the sacrificial conductor by etching after the exposing step; and forming an internal magnetic path by filling a portion where the sacrificial conductor has been removed with a magnetic material.

3. The manufacturing method for the electronic component according to claim 2, wherein the magnetic material contains metallic magnetic powder.

4. The manufacturing method for the electronic component according to claim 2 further comprising:

forming a first through-hole penetrating the insulator substrate in a laminating direction at a portion where the sacrificial conductor has been removed.

5. The manufacturing method for the electronic component according to claim 1, further comprising:

forming a second through-hole penetrating the insulator substrate while taking the sacrificial conductor exposed by the exposing step as a target mark in the forming.

6. The manufacturing method for the electronic component according to claim 1, further comprising:

making the coil conductor thicker with plating.

7. A manufacturing method for an electronic component including a multilayer body formed by laminating an insulator substrate and an insulator layer, a coil including a coil conductor provided on the insulator substrate, and an internal magnetic path penetrating the insulator substrate, the method comprising:

forming the coil conductor and a sacrificial conductor provided at a portion where an internal magnetic path of the insulator substrate is to be formed, at the same time on the insulator substrate;

laminating the insulator layer on the insulator substrate so as to cover the coil conductor and the sacrificial conductor;

exposing the sacrificial conductor by removing part of the insulator layer laminated on the insulator substrate using a polishing process;

removing the sacrificial conductor by etching after the exposing step; and forming an internal magnetic path by filling a portion where the sacrificial conductor has been removed with a resin containing magnetic powder.

* * * * *